US005453032A

United States Patent [19]

Crowe

[11] Patent Number: 5,453,032

[45] Date of Patent: Sep. 26, 1995

[54] BIOMECHANICALLY ALIGNING TOW ROPE HANDLE

[76] Inventor: Edward H. Crowe, 112 McKelvey Ave., Bakersfield, Calif. 93308

[21] Appl. No.: 365,888

[22] Filed: Dec. 29, 1994

[51] Int. Cl.[6] ..... A63C 15/06

[52] U.S. Cl. ..... 441/69

[58] Field of Search ..... 441/65, 68, 69; 16/111 R, 125; 403/285; 114/253

[56] References Cited

U.S. PATENT DOCUMENTS

| | | | |
|---|---|---|---|
| D. 283,908 | 5/1986 | Ziomek | 441/69 |
| 2,998,797 | 9/1961 | Risney | 441/69 |
| 3,219,007 | 11/1965 | Kiefer | 441/69 |
| 4,280,240 | 7/1981 | Neuscheler | 441/69 |
| 4,371,352 | 2/1983 | Holland | 441/69 |
| 4,533,334 | 8/1985 | Ziomek | 441/69 |
| 4,867,722 | 9/1989 | Joseph | 441/69 |

OTHER PUBLICATIONS

"Get A Handle On It–Choosing A Handle Starts With Understanding Its Construction" by Mick Neville (from Water Ski magazine, Aug. '92) 2 pages from a prior admitted catalog.

*Primary Examiner*—Stephen Avila
*Attorney, Agent, or Firm*—R. Joseph Trojan

[57] ABSTRACT

A biomechanically aligning water sport tow rope handle comprising tow bar angled at its midpoint forming a first and a second hand grip, support arms secured to each end of the bar and to the midpoint of the bar with each of the support arms secured to a tow rope.

8 Claims, 2 Drawing Sheets

BIOMECHANICALLY ALIGNING TOW ROPE HANDLE

BACKGROUND OF THE INVENTION

1. Field of the Invention

This invention relates to tow rope handles used in various sporting activities in which a person is pulled at the end of a rope.

2. Background of the Invention

The conventional tow rope handle in use today for water skiing, knee boarding, wake boarding and other towed water sports, consists of a single straight bar connected to the tow rope by a V-shaped portion of rope. The standard grip a person uses for such a handle is called the baseball grip. The grip involves the user holding the top of the bar with one hand, defined as the top grip position, and holding the bottom of the bar with the other hand, defined as the bottom grip position. The baseball grip is widely recognized as permitting the greatest maneuverability for the user.

The top grip position will result in the person's arm being relatively straight with little bending of the elbow. However, the wrist will be flexed upward and the shoulder will be rotated toward the vertical mid-line of the user's body. The flexing of the wrist while being pulled causes strain on the wrist, which can cause injury. Some users of tow ropes wrap their wrists to provide additional support to combat wrist fatigue. The rotation of the shoulder also causes additional strain.

The bottom grip position of the baseball grip creates even greater biomechanical stresses. Specifically, the wrist is bent downward, the shoulder rotated away from the vertical midline of the body, and the elbow is bent. The reader will quickly discover this fact by gripping any straight elongated object using the baseball grip. Hence, the bottom grip has three biomechanical stress points, the wrist, the shoulder, and the elbow, when the person is under tow. Some users develop tendonitis in the elbow as a result and wrap the elbow joint to try to reduce the stress while skiing.

As a result of the differences in the biomechanics of the top and bottom grip positions, the user's power in controlling the bar comes from the triceps of the arm in the top position and the biceps of the arm in the bottom position. This causes several disadvantages. Since the user's tricep is invariably stronger than the user's bicep, the user's bottom arm becomes tired more quickly. This is further compounded by the fact that bottom position places the wrist and elbow in a bent position, which only adds to the stress from fatigue and torsion. A natural consequence of these factors is that the user experiences diminished control in the bottom arm relative to the top arm. Overall, the prior art device results in a reduction in the length of time that the user can engage in the sport due to fatigue. Also, the V-shaped portion of rope attached to the traditional handle is subject to uneven wear and tear due to the uneven loads placed upon each side of the handle for the reasons stated above.

The present invention addresses the shortcomings of the prior art because it is designed to biomechanically align the the shoulder, the elbow, and the wrist of each arm along a single axis. By aligning the joints in this manner, the stress is transferred to the muscles of the upper shoulders and upper back. These muscles typically have greater strength than the muscles of the arms. For this reason, they are less susceptible to fatigue. Additionally, transferring the stress to these muscles prevents injury to the wrist and elbow joints.

The present invention is able to achieve biomechanical alignment of the joints by primarily two distinguishing modifications to the prior art. First, the tow bar is bent at its midpoint. This results in a first and a second grip arm, each of which is angled downward from the midpoint. The user can hold the device with both hands in the top position without any loss of maneuverability, which typically occurs when a conventional straight tow bar is gripped with both hands in the top position. Furthermore, maneuverability is enhanced. The inventor has observed that 360° spins are easier with the invention because the angled grips are in a more natural position to grasp when passing the tow bar behind one's back during the spin.

The construction of an angled tow bar has two biomechanical consequences. First, the elbows of both arms are able to remain straight since the bottom grip position is no longer required. Secondly, the shoulders are no longer rotated. For a person to hold an elongated object in a horizontal position in front of him or herself requires the rotation of the shoulder joint. By angling the first and second grip arms downward, the present device can be gripped without the need for rotation of the shoulder joints. This results in axial alignment of the elbow and shoulder joints. However, the wrist joints are still not in axial alignment with the other joints because they are still bent in an upward position.

It is the second structurally distinguishing feature of the invention that serves to bring the wrist joints into biomechanical alignment with the elbow and shoulder joints. Each of the angled grip arms has a terminal end at which a branch of the tow rope is secured. Additionally, at the midpoint of the tow bar, a third branch of the tow rope is attached. The third branch is sufficiently shorter than the other two branches so that the midpoint of the tow bar tilts forward when the tension is placed upon the rope. By tilting the midpoint forward, the wrists are no longer bent upward when holding the grip arms. Hence, the shorter third branch serves to bring the wrist joints into biomechanical alignment with the elbow and shoulder joints thereby permitting the stress of the tow rope to be transferred to the upper back and shoulders. Furthermore, since the handle has three support branches, each portion of the connecting rope's wear and tear is reduced from one half in the conventional model to one third in the present invention. The result is a more pleasurable sporting experience with less strain and fewer injuries.

SUMMARY OF THE INVENTION

One of the main objects of the present invention is to provide a tow rope handle that will biomechanically align the user's joints to effectively transfer the strain of being pulled to the upper arms and back;

Another object of the present invention is to evenly balance the load on the user's muscles on each side of the user's body;

A further object of the invention is to reduce the risk of injury and tendonitis to the wrists, elbows, and shoulder joints of the user;

An additional objection of the present invention is to increase the ability of the user to perform trick maneuvers such as 360° spins.

Yet another object of the invention is to reduce the wear and tear on the connecting tow rope by more evenly balancing the load on the connecting branches of the rope;

An additional object of the invention is to provide a tow

S rope that will permit the user to obtain increased endurance and pleasure through its use;

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which.

DETAILED DESCRIPTION OF THE PREFERRED EMBODIMENT

Figure 1:
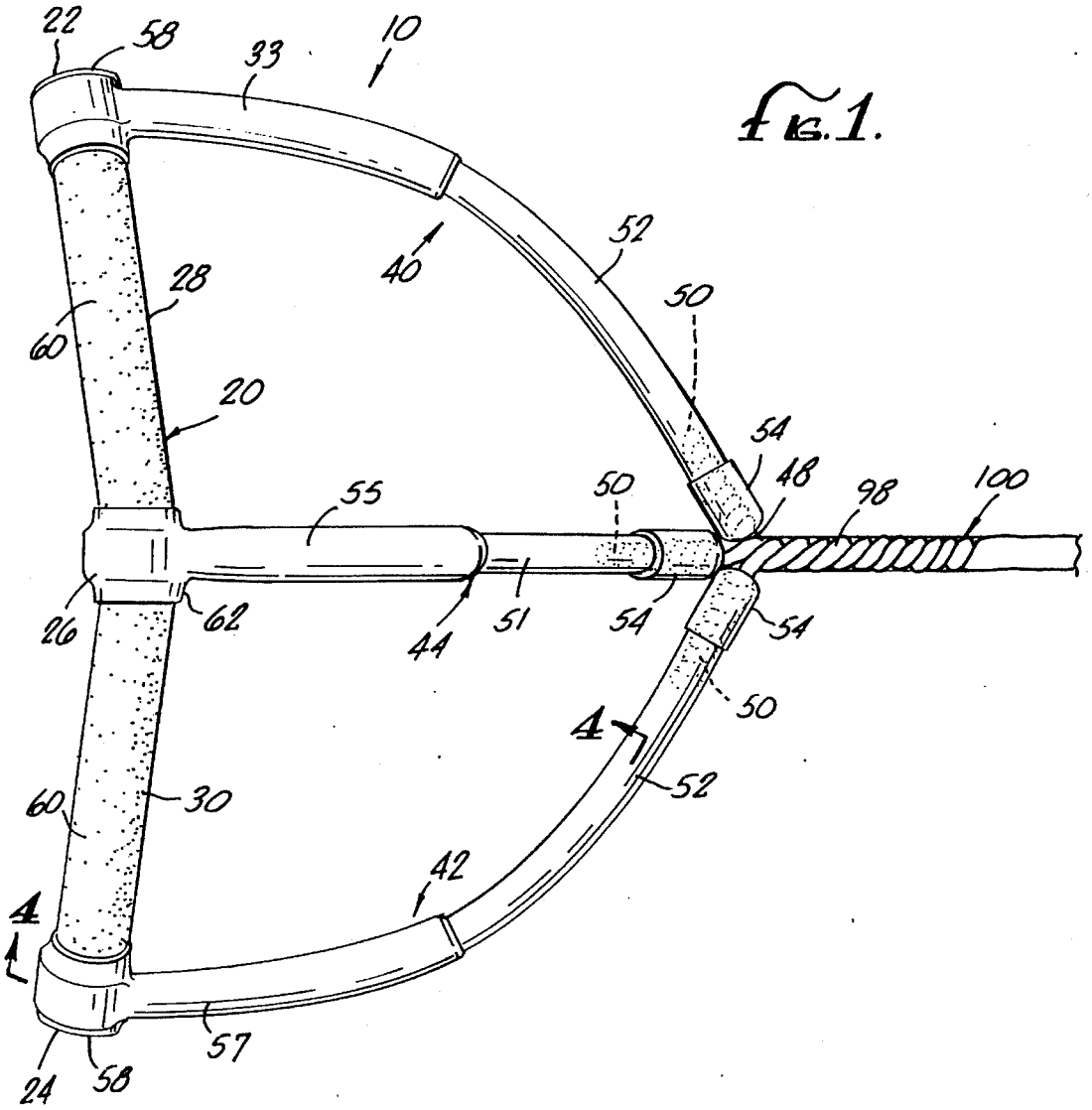
FIG. 1 is a top view of the invention with the rope branches from each of the support arms braided.

FIG. 1 illustrates the present invention 10, a tow rope handle, secured to a conventional tow rope 100. The handle 10 includes an angular bar 20 secured to the tow rope 100 by a first lateral support arm 40, a second lateral support arm 42, and a central support arm 44. Each of the support arms is made of nylon rope in the preferred embodiment, but may be made of any appropriate material.

The angular bar 20 has a first end 22, a second end 24, and a midpoint 26. The bar 20 is bent at the midpoint 26 thereby forming a first grip 28 and a second grip 30. The first grip 28 has a first axis 32 and the second grip 30 has a second axis 34. The intersection of the first and second axis 32, 34 form a deflection angle 38. The deflection angle 38 may be in the approximate range of 55 to 85 degrees. The optimum deflection angle 38 is approximately 72 degrees. The first arm 40 is secured to the first end 22 and the second arm 42 is secured to the second end 24. The central arm 44 is secured to the midpoint 26.

In the preferred embodiment, the grips 28, 30 are covered in a non-slip material 60 such as tire rubber. Other versions of the grip surface could be padded for comfort, vinyl for durability, or grooved to direct water away from the user's grip. The bar 20 itself can be made of any appropriate material such as metal, plastic or wood. The inventor has had success using hollow aluminum bars, which are mechanically bent at the midpoint 26 to the appropriate angle 38. However, angular molds or tooling could be used as well. The preferred length of bar 20 is approximately 40 centimeters.

Other embodiments of the invention can include grips 28, 30, which are separate units joined at the midpoint 26 by any appropriate fastening means. The fastening means could be adjustable so the first and second grips 28, 30 could be placed at different deflection angles 38 for the comfort or needs of various users. In the interests of safety, the joint would need to including locking means so that adjustment of the deflection angle 38 could not occur inadvertently during use.

Figure 2:
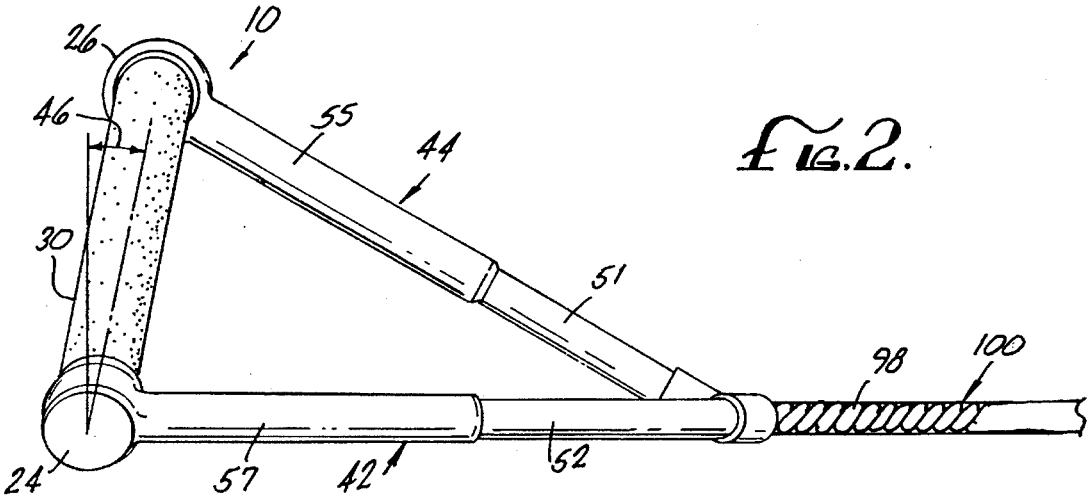
FIG. 2 is a side view of the invention while the invention is in tension. The angle indicates the grip's angle from the perpendicular.
Figure 3:
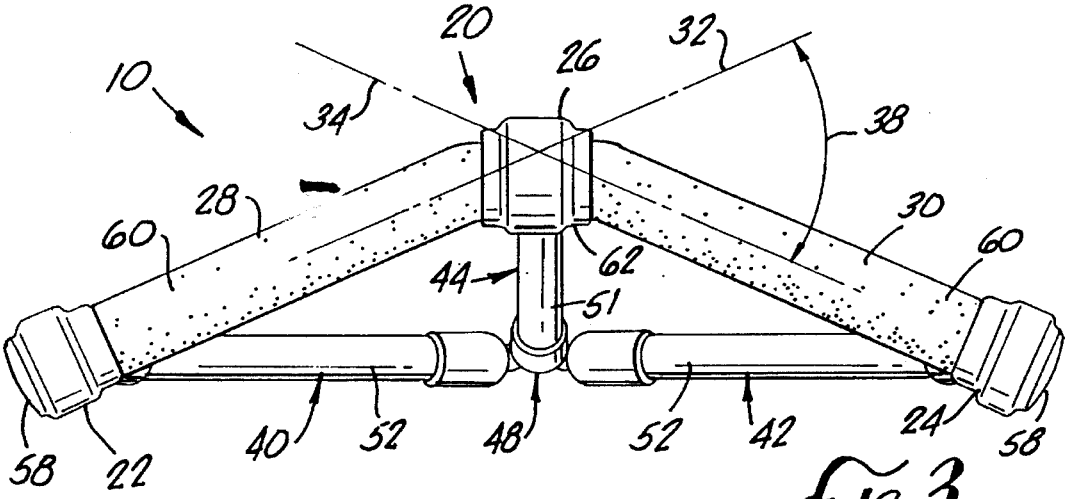
FIG. 3 is the front elevation view of the invention. The angle on this version of the invention indicates the bend of the handle bar from a straight bar.

As shown in FIG. 2, the handle 10 and tow rope 100 is shown in tension as it would be while in use. When in use, the handle 10 tilts forward forming wrist angle 46. The wrist angle can be in the range of approximately 5 to 15 degrees from the perpendicular with the optimum angle being approximately 10 degrees. The wrist angle 46 is primarily determined by the length of the central arm 44 relative to the lengths of the first and second lateral arms 40, 42. The arms 40, 42, 44 are joined to the tow rope 100 at a nexus point 48. By shortening the length of the central arm 44 relative to the first and second lateral arms 40, 42, one is able to increase the wrist angle 46. For example, one can create an optimal wrist angle if the lengths of the lateral arms 40, 42 are both twenty-eight centimeters and the length of the central arm 44 is twenty-three centimeters based upon measuring the lengths from the nexus point 48 to the point at which they contact the bar 10. The wrist angle 46 serves to straighten the wrist while in use thus reducing the incidence of injury and fatigue by transferring the load to the muscles of the upper arm, back and shoulder.

Figure 4:
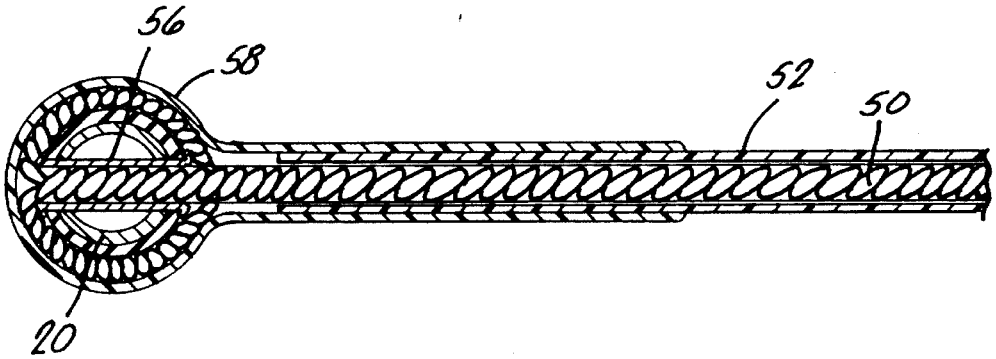
FIG. 4 is the right side cross-sectional view of the preferred version of the invention where a rope branch passes through a rope shaft in the handle bar and splits around the handle bar.

FIG. 4 shows a cross section of the lateral support arm 40. The arms 40, 42, 44 can be made of any flexible material such as a nylon rope 50 and need not include all of the additional elements shown in the drawings. However, in the preferred embodiment shown in FIG. 4, the rope 50 is encapsulated within a hollow plastic tube 52 to prevent injury to the rope. A cap 54 covers end of the tube 52. The rope 50 encircles the handle bar 20. The handle bar may include a rope shaft 56 through the center of the handle bar 20 through which the rope 50 can be threaded. The rope 50 passes through a rope shaft 56 and is split to encircle the handle bar 20. A protective end cap 58 encapsulates the end of the bar 10 and extends down the tube 52. The second lateral support arm 42 is constructed in the same manner. The central support arm 44 also can be constructed in the same manner, except that the bar 10 passes completely through the protective cap 62.

The inventor has observed certain advantages to securing the central arm 44 to the bar 10 in a different manner than that described for the first and second lateral support arms 40, 42. The inventor prefers to rap the rope 50 of the central arm 44 around the midpoint 26 of the bar 10 without incorporating a rope shaft 56 for the central arm. There are two advantages to this construction. First, by not drilling a hole into the midpoint 26 of the bar 10 for a rope shaft 56, the structural integrity of the bar 10 is preserved at the critical stress point at which the bar 10 is bent. Secondly, if the bar is an aluminium hollow bar, the inventor has observed that the bar 10 will float. The end caps 58 are sufficient to create an air-tight seal that creates an air pocket within the hollow bar 10, which keeps the bar 10 afloat. This is an advantage because most conventional ski rope handles sink. If a central rope shaft 56 is incorporated into the invention, then water tends to fill the inside of the hollow bar causing it to sink.

The advantages of the water sport tow rope handle 10 is a more even distribution of load on the user's arms by virtue of its two grips 28 and 30. The handle 10 will reduce the number of elbow and wrist injuries by straightening the user's arms, elbows and wrist. This places the majority of the load on the user in the upper arms, shoulder and back and will reduce the incidence of fatigue and twisting injury to the wrist and elbow.

The version of the invention depicted in the drawings has support arms 40, 42 and 44 that are flexible. Other versions of the support arms 40, 42 and 44 could be completely rigid to the caps 54 or rigid only through the end caps 33, 57 and central cap 55. The support arms 30, 40 and 41 may joined by weaving the arms together to form a braid 98, which can become, or be joined, to the main tow rope 100.

For example, the grips 28 and 30 could be made of alternate materials such as wood to allow for flotation, or a combination of materials such as metal and plastic for a balance of strength and cost efficiency. Also, the handle could be modified in size and grip angle for use by various water sports such as water skiing and knee boarding as well as for the recreational and professional user.

Although the present invention has been described in considerable detail with reference to certain preferred versions thereof, other versions are possible. The spirit and scope of the appended claims should not be limited to the description of the preferred versions contained herein.

What is claimed is:

1. A tow rope handle comprising:

a bar having a midpoint, said bar angled at approximately said midpoint forming a first angular grip and a second angular grip, said first grip having a first terminal end and said second grip having a second terminal end;

a first lateral support arm secured to said first terminal end and a second lateral support arm secured to said second terminal end, said first and second support arms having lengths that are substantially equal;

a central support arm secured to said elongated bar at approximately said midpoint and having a length sufficiently shorter than said lateral support arms to tilt said midpoint toward a tow rope; and, means for securing said first support arm, said second support arm, and said central support arm to tow rope.

2. A tow rope handle as in claim 1, wherein said tilting forward of said midpoint forms a wrist angle, said wrist angle having an approximate range from 5 to 15 degrees.

3. A tow rope handle as in claim 1, wherein said tilting forward of said midpoint forms a wrist angle of approximately 10 degrees.

4. A tow rope handle comprising:

a bar having a midpoint, said bar angled at approximately said midpoint forming a first angular grip and a second angular grip, said first grip having a first terminal end and said second grip having a second terminal end, said first grip having a first axis and said second grip having a second axis, said first axis and said second axis intersecting each other to form a deflection angle having an approximate range from 55 to 85 degrees;

a first lateral support arm secured to said first terminal end and a second lateral support arm secured to said second terminal end, said first and second support arms having lengths that are substantially equal;

a central support arm secured to said elongated bar at approximately said midpoint and having a length sufficiently shorter than said lateral support arms to tilt said midpoint toward a tow rope; and, said first support arm, said second support arm, and said central support arm secured to said tow rope.

5. A tow rope handle as in claim 4, wherein said tilting forward of said midpoint forms a wrist angle, said wrist angle having an approximate range from 5 to 15 degrees.

6. A tow rope handle as in claim 4, wherein said tilting forward of said midpoint forms a wrist angle of approximately 10 degrees.

7. A tow rope handle comprising:

a first grip and a second grip, said first grip and second grips secured to each other to form a deflection angle having a range of approximately 55 to 85 degrees, said first grip having a first terminal end and said second grip having a second terminal end;

a first lateral support arm secured to said first terminal end and a second lateral support arm secured to said second terminal end, said first and second support arms having lengths that are substantially equal;

a central support arm secured to said elongated bar at approximately said midpoint and having a length sufficiently shorter than said lateral support arms to tilt said midpoint toward a tow rope; and, means for securing said first support arm, said second support arm, and said central support arm to said tow rope.

8. A tow rope handle as in claim 7, wherein sufficiently shorter than said lateral support arms to tilt said midpoint toward said tow said tilting forward of said midpoint form a wrist angle, said wrist angle having an approximate range from 5 to 15 degrees.

* * * * *